US007611133B2

(12) United States Patent
Sussmeier et al.

(10) Patent No.: US 7,611,133 B2
(45) Date of Patent: Nov. 3, 2009

(54) METHOD AND SYSTEM FOR ENHANCED CUTTER THROUGHPUT

(75) Inventors: John W. Sussmeier, Cold Spring, NY (US); Gregory P. Skinger, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 431 days.

(21) Appl. No.: 11/581,024

(22) Filed: Oct. 13, 2006

(65) Prior Publication Data

US 2008/0106022 A1 May 8, 2008

(51) Int. Cl.
*B41F 13/54* (2006.01)

(52) U.S. Cl. ..... 270/5.03; 270/5.02; 270/52.07; 270/52.09; 270/52.11

(58) Field of Classification Search ..... 270/5.02, 270/5.03, 21.1, 52.07, 52.09, 52.11, 52.22; 83/56, 371, 425
See application file for complete search history.

(56) References Cited

U.S. PATENT DOCUMENTS 4,273,319 A * 6/1981 Stocker ..... 270/21.1
4,527,790 A * 7/1985 Piotroski ..... 270/52.09
6,309,487 B1 * 10/2001 Herrin et al. ..... 156/73.1
6,467,763 B1 * 10/2002 Depoi et al. ..... 270/52.09
6,792,332 B1 * 9/2004 DePoi ..... 700/213
2004/0237738 A1 * 12/2004 Sussmeier et al. ..... 83/27
2005/0056989 A1 * 3/2005 Schwab ..... 271/187

* cited by examiner

*Primary Examiner*—Leslie A Nicholson, III
(74) *Attorney, Agent, or Firm*—Christopher H. Kirkman; Angelo N. Chaclas

(57) ABSTRACT

An improved inserter input system and method for transversely cutting a web of printed material into separate sheets, the web including a plurality of separated side-by-side sheets. A set of sheets on the web is transported to the cutting device. One or more of the sheets in the set belongs to a new collation for which sheets have not previously been cut. The system determines whether sufficient collation parking spots exist to accommodate a new collation. If there are no available collation parking spots, and if all of the sheets in the set belong to the new collation, then transverse cutting is delayed until an open collation parking spot becomes available. If there are no available collation parking spots, and if a subset of sheets belong to a prior collation, then the web is partially cut to separate only the sheet, or sheets, that belong to the prior collation. The cutting of the other sheet(s) is delayed until the open collation parking spot becomes available. If there is an available collation parking spot, then the cutting device transversely cuts the entire set of side-by-side sheets.

16 Claims, 7 Drawing Sheets

METHOD AND SYSTEM FOR ENHANCED CUTTER THROUGHPUT

TECHNICAL FIELD

The present invention relates to an inserter input system for generating sheets of printed material to be collated and inserted into envelopes. Such an inserter input system cuts and processes a continuous web of material into individual sheets. The individual sheets may then be processed into mail pieces.

BACKGROUND OF THE INVENTION

Inserter systems, such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item are substantially identical for each addressee. Examples of such inserter systems are the 8 series, 9 series, and APST™ inserter systems available from Pitney Bowes Inc. of Stamford, Conn.

In many respects, the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

The input stages of a typical inserter system are depicted in FIG. 1. At the input end of the inserter system, rolls or stacks of continuous printed documents, called a "web," are fed into the inserter system by a web feeder 10. The web is often comprised of two sheets printed side-by-side across the width of the web. The continuous web must be separated into individual document pages. This separation is typically carried out by a web cutter 20 that cuts the continuous web into individual document pages. Downstream of the web cutter 20, a right angle turn 30 may be used to reorient the documents, and/or to meet the inserter user's floor space requirements.

The separated sheets must subsequently be grouped into collations corresponding to the multi-page documents to be included in individual mail pieces. This gathering of related document pages occurs in the accumulator module 40 where individual pages are stacked on top of one another.

The control system for the inserter senses markings on the individual pages to determine what pages are to be collated together in the accumulator module 40. In a typical inserter application, mail pieces may include varying numbers of pages to be accumulated.

Downstream of the accumulator 40, a folder 50 typically folds the accumulation of documents, so that they will fit in the desired envelopes. To allow the same inserter system to be used with different sized mailings, the folder 50 can typically be adjusted to make different sized folds on different sized paper. As a result, an inserter system must be capable of handling different lengths of accumulated and folded documents.

Downstream of the folder 50, a buffer transport 60 transports and stores accumulated and folded documents in series in preparation for transferring the documents to the synchronous inserter chassis 70.

In a typical embodiment of a prior art web cutter 20, the cutter is comprised of a guillotine blade that chops transverse sections of web into individual sheets. This guillotine arrangement requires that the web be stopped during the cutting process.

A frequent limitation on speed of an inserter system is the ability of the system to handle all of the generated documents if the system is required to stop. An input system may be capable of going very fast under non-stop operating conditions, but a problem arises during stopping if there isn't a means to handle all the sheets produced by the input system. Thus in designing input stages to an inserter system, a consideration is to provide a place for all "work-in-progress" sheets and collations, assuming that the system may be required to stop at any time. A buffer module such as the ones described in U.S. Pat. Nos. 6,687,569 and 6,687,570 issued Feb. 3, 2004 and assigned to the assignee of the present application, may be used to provide stopping stations, or "parking spots," for work-in-progress documents.

For proper operation, an inserter input system should not be run faster than spaces for holding work in progress can be made available. For mail runs including mail pieces having larger numbers of sheets, the problem is less severe since sheets from the same mail piece are stored together in the buffer stations. For mail runs with mail pieces only having a few sheets, the ratio of required stopping stations to the number of sheets generated will be greater, and the inserter input may be required to slow down, or to pause.

For existing systems with webs having "2-up" side-by-side sheets, some additional logic has been used to control cutting and to facilitate throughput. This logic is applicable when a set of 2-up sheets is presented to the guillotine cutter for cutting, and at least one of the sheets belongs to a new collation to be started.

If both of the 2-up sheets belong to the same collation, and if there is an available parking spot, then both sheets are cut in a continuous stroke of the guillotine cutter.

If the sheets in the set are from different collations then two single cuts are performed. The first cut is done by a partial cutting operation. As is known in the art, a guillotine blade can be also be used to perform a partial cut across the width of the web. This is accomplished by partially lowering the sloped blade, as seen in FIGS. 4A-4C. In prior art systems, a gap was always required between sheets belonging to different collations. Thus, if the sheets belong to different collations, the prior art systems required that the sheets from different collations be cut and fed separately in this partial cut manner. After the desired gap has been achieved, the second sheet is cut by fully lowering the guillotine blade, so that the remaining sheet is separated and carried away. If there is no additional parking spot available, only the first sheet is cut, and the guillotine blade pauses until a parking spot is available before finishing the single cutting of the second sheet.

SUMMARY OF THE INVENTION

The present invention represents an improvement over the prior art by providing improved throughput. Instead of performing two single cuts when side-by-side sheets belong to different collations, a system and method are provided so that the sheets are cut more efficiently, and with less delay.

Accordingly, an improved inserter input system and method are used for transversely cutting a web of printed material into separate sheets. The web includes at least two side-by-side sheets printed transversely across a width of the web. Typically, 2-up style sheets are used, but it will be recognized by one of skill in the art that the invention is applicable for other configurations with more than two sheets across the width of the web. The side-by-side sheets are separated from each other in a direction parallel to a length of the web, typically by a web slitting device.

A set of side-by-side sheets is transported to the cutting device which is preferably a guillotine cutter. The improved system becomes applicable when one or more of the sheets in the set belongs to a new collation for which sheets have not previously been cut. The system determines whether sufficient collation parking spots exist to accommodate a new collation. If there are no available collation parking spots, and if all of the sheets in the set belong to the new collation, then transverse cutting is delayed until an open collation parking spot becomes available. If there are no available collation parking spots, and if a subset of sheets belong to a prior collation, then the web is partially cut to separate only the sheet, or sheets, that belong to the prior collation. The cutting of the other sheet(s) is delayed until the open collation parking spot becomes available. If there is an available collation parking spot, then the cutting device transversely cuts the entire set of side-by-side sheets.

In the preferred embodiment, the step of partially transverse cutting is achieved by partially lowering the sloped guillotine blade. Scanners may also be used to scan identifying markings to determine what collation a sheet belongs to by scanning a marking on the sheet.

In the preferred embodiment, after cutting, sheets are transported away from the cutter and shingled. In this embodiment, shingling is accomplished by a right angle turn module. Also, a high speed transport is used to separate sheets out of the shingled arrangement by pulling the lead sheet out of the stream of shingled sheets. After high speed separation of the sheets, the desired collations are formed downstream in an accumulator module.

Further details of the present invention are provided in the accompanying drawings, detailed description, and claims.

DETAILED DESCRIPTION

Figure 1:
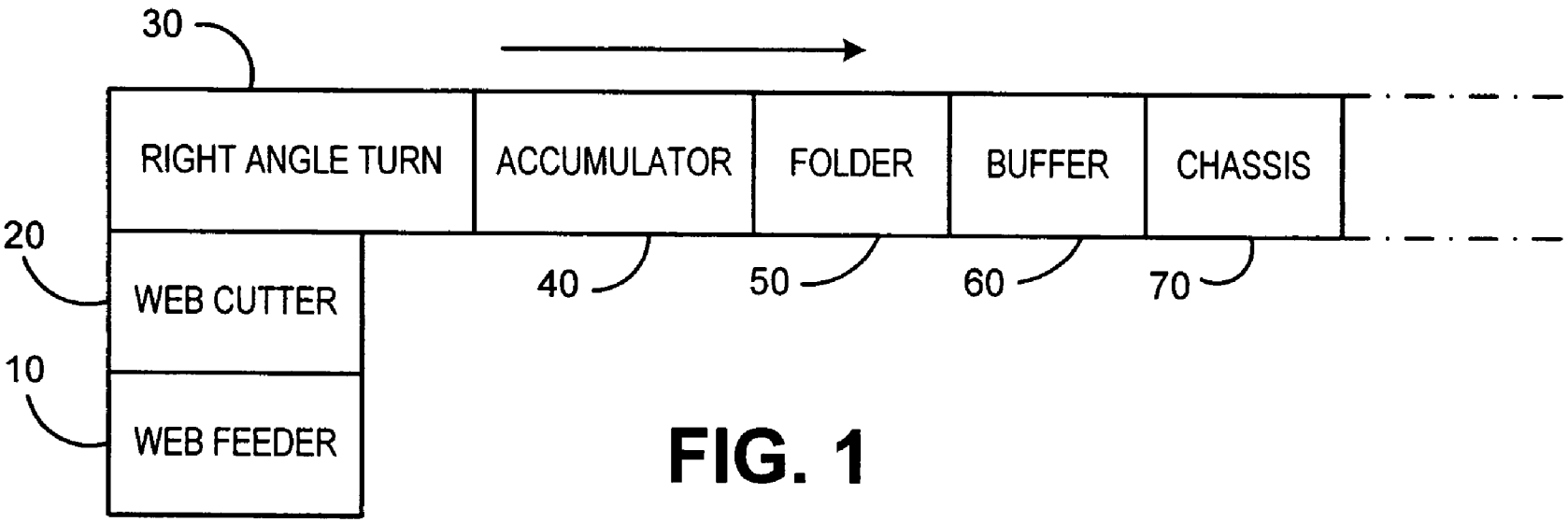
FIG. 1 is a diagram of the input stages of an inserter system for use with the present invention.
Figures 2, 2A:
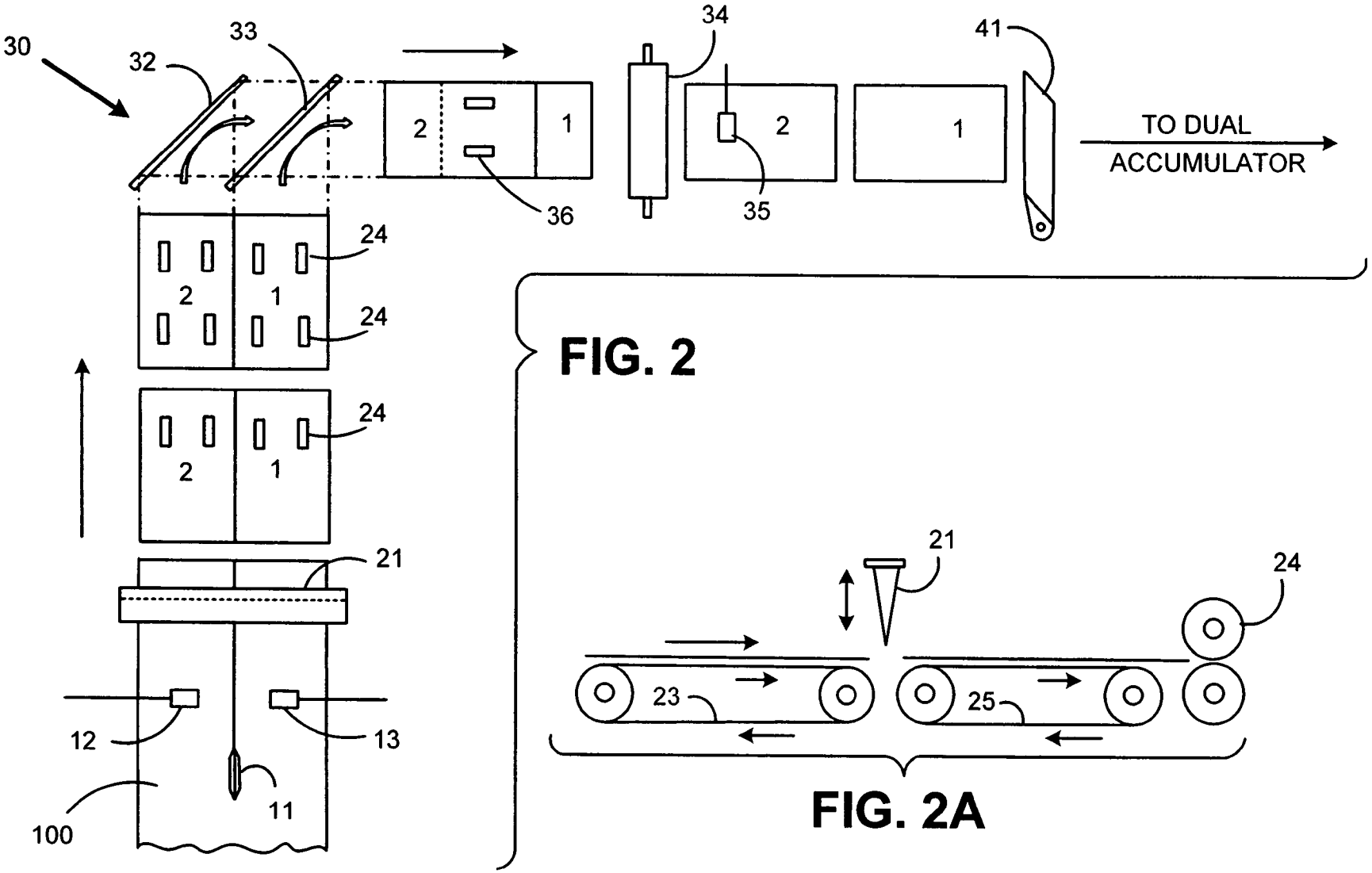
FIG. 2 depicts a preferred arrangement of inserter input devices in accordance with the present invention cutting and transporting documents.
FIG. 2A depicts a guillotine cutter and transport arrangement for use with the present invention.

A preferred embodiment for implementing the present invention is depicted in FIG. 2. The components depicted in FIG. 2 may be associated with the general input stages depicted in FIG. 1, however it is not necessary that the particular components be part of any particular module, so long as they perform as described herein.

A web 100 is drawn into the inserter input subsystem. Methods for transporting the web are known and may include rollers, or tractors pulling on holes along a perforated strip at the edges of the web. The web 100 is split into two side-by-side portions by a cutting device 11. Cutting device 11 may be a stationary knife or a rotating cutting disc, or any other cutting device known in the art. While the embodiment in FIG. 2 shows the web being split into two portions, one skilled in the art will understand that a plurality of cutting devices 11 may be used to create more than two strands of web from the original one. Further, the processing steps described below will also be as applicable to webs that are split into more than two portions.

Sensors 12 and 13 scan a mark or code printed on the web. The mark or code identify which collation and mail piece that particular portion of web belongs to, and provides instructions for processing and assembling the mail pieces. In addition to using the scanned information for providing assembling instructions, the scanning process is useful for tracking the documents' progress through the mail piece assembly process.

Once the location of a document is known based on a sensor reading, the document's position may be tracked throughout the system by monitoring the displacement of the transport system. In particular, encoders may be incorporated in the transport systems to give a reliable measurement of displacements that have occurred since a document was at a certain location.

After the web 100 has been split into at least two portions, the web is then cut into individual sheets by cutter 21. Cutter 21 is preferably a guillotine cutter comprised of a sloped blade that extends across the width of the web. The cut is made across the web, transverse to the direction of transport. FIG. 2A provides a further side view of the cutting area.

The set side-by-side of sheets to be cut by cutter 21 rests upon a continuous transport 25. Transport 25 is preferably comprised of belts have a low co-efficient of friction such that the belts slip underneath the web prior to the sheets being cut. Once one or more sheets have been cut by cutter 21, the transport 25 urges the sheets into nips 24 for removal to the right angle turn 30. Nips 24 are positioned slightly more than one sheet length downstream of cutter 21, so that cut sheets 1 and 2 can be immediately ingested and transported once they are cut away from the web.

Right angle turn devices 30 are known in the art and will not be described in detail here. However, and exemplary right angle turn will comprise turn bars 32 and 33. Of the two paper paths formed by the right angle turn 30, turn bar 33 forms an inner paper path for transporting sheet 1. Turn bar 32 forms a longer outer paper path on which sheet 2 travels.

Because sheets 1 have a shorter path through the right angle turn 30, a lead edge of sheet 1 will be in front of a lead edge of sheet 2 downstream of the right angle turn 30. Also, the turn bars 32 and 33 are arranged such that sheet 2 will lay on top of sheet 1 downstream of the right angle turn, thus forming a shingled arrangement. Downstream of the right angle turn 30, further sets of roller nips 36 transport the shingled arrangement of sheets.

In a preferred embodiment, the turn bars 32 and 33 are further arranged so that a lead edge of a subsequent sheet on the shorter path will catch up to, and pass, the trailing edge of the prior document on the longer path. The result of this arrangement can be seen in FIG. 3, where sheet 1 is the sheet that traveled on the shorter path through the right angle turn. Sheet 2 was previously side-by-side with sheet 1, but is now shingled on top of sheet 1. Sheet 3 is a sheet that followed sheet 1 on the shorter paper path through the right angle turn 30, and a lead portion of sheet 3 is now shingled under sheet 2. Finally, sheet 4, previously the side-by-side portion paired with sheet 3, is shingled on top of the rear portion of sheet 3.

In accordance with a preferred embodiment of the present invention, all of the transport mechanisms between the cutter 21 and high speed separation nip 34 operate at the same speeds. Collectively, the transport mechanisms may be referred to herein as the "right angle turn transport," and include rollers 24, 36, and turn bars 32 and 33. Preferably the components of the right angle turn transport are electronically or mechanically geared to one another so that speeds are always consistent throughout.

The shingling of sheets provides a means for storing a greater number of sheets in a smaller amount of space. Thus, the prior art problem of a need for parking spots is partially mitigated. Upon the occurrence of a stopping condition the right angle turn transport 30 is subjected to a controlled deceleration to receive and store the extra sheets before coming to a complete stop.

Figure 3:
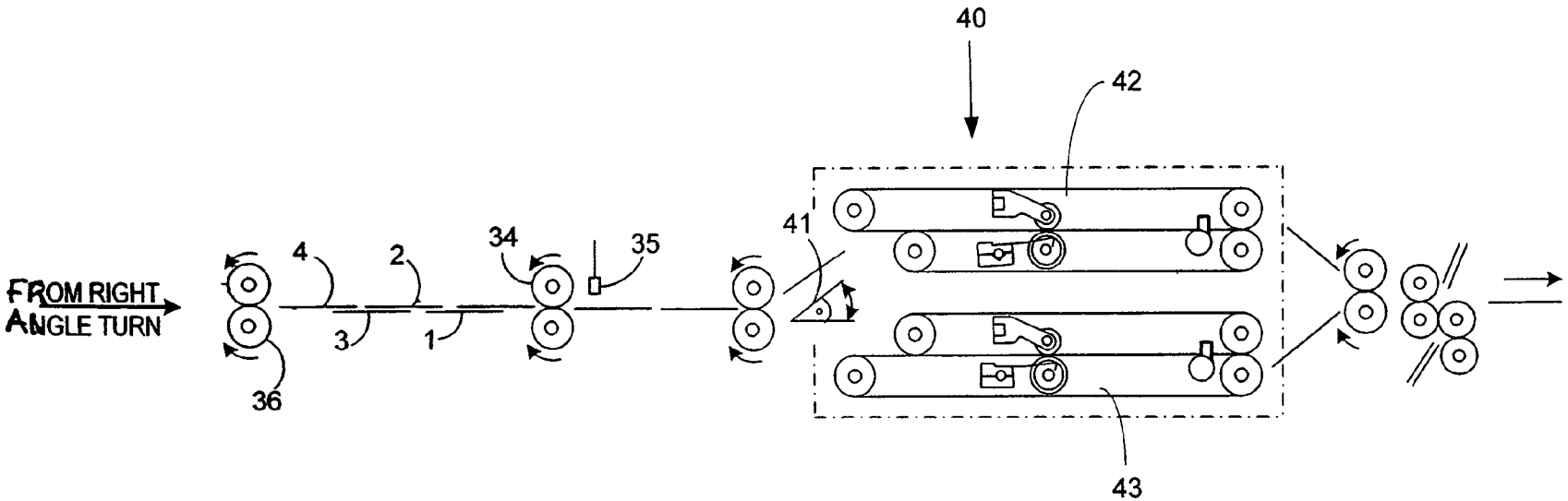
FIG. 3 depicts a side view of the document flow downstream of the right angle turn in accordance with a preferred embodiment of the present invention.

Referring to FIG. 3, the shingled sheets 1, 2, 3, 4, must be unshingled. After they are unshingled, they can be accumulated into their respective collations. This is accomplished by the high speed separation nip 34. As the name suggests, nip 34 operates at a higher speed than the upstream right angle turn 30 transports and pulls the lead edges of sheets out of the shingled arrangement. The speed of the high speed separation nip 34 is selected so that downstream of the nip 34 the sheets are traveling serially, and are separated by a predetermined gap. Preferably, high speed separation nip 34 operates at a constant high velocity, and is not necessarily controlled as part of a stoppage condition.

Downstream of nip 34, a sensor 35 scans a code on the sheets. Once again, this scanned code can link the particular sheet to a set of instructions for assembling the mail pieces. Sensor 35 further is used to confirm that the sheets detected by sensors 12 and 13 have arrived as expected by detecting a lead edge of the sheet. Of particular interest at this stage of the production process is the number of sheets belonging to a particular mail piece, and which sheets go together to form the same mail piece. Based on mail piece information determined from the sensors, flipper gate 41 directs sheets belonging to the same mail piece to one of two accumulator bins 42 and 43 of accumulator 40.

Any type of accumulator may be used, however, the accumulator 40 depicted in FIG. 3 is based on the one from U.S. Pat. No. 6,644,657 issued Nov. 11, 2003. Another dual accumulator is described in U.S. Pat. No. 5,083,769 issued Jan. 28, 1992.

While one accumulator bin (42 or 43) is receiving documents to be stacked into an accumulation, the other bin transfers its completed stack to the next stage for processing. Downstream of the accumulator 40, collations of sheets are returned to a single paper path. In a typical embodiment, the next processing station downstream of the accumulator 40 will be a folder 50 configured to fold the collation to a required by the control system.

In a further preferred embodiment, the velocities of the right angle turn transport and the high speed separator nip 34 are controlled to provide consistent sheet spacing relationships to facilitate high speed processing. This embodiment ensures adequate sheet separation after the sheets are ingested at nip 34 to allow flipper gate 41 adequate time to switch to the alternate accumulation bins 42 or 43.

In this preferred embodiment, the velocity if the right angle turn transports (24, 36) are set such that all lead edge sheet spacing displacements within the right angle turn 30 are equal to the width of the document, Wdoc, at the instantaneous cutter rate. By setting the right angle turn spacing displacements to $W_{doc}$, the velocity of the high speed nip 34 can be minimized to generate a desired inter-sheet gap to allow reliable upper and lower dual accumulator flipping. This constant sheet spacing also provides the added benefit of simplified control. Since the right angle turn 30 transport is preferably electronically geared to the cutter 21, the lead edge sheet-to-sheet spacing displacement in the web will always be preserved. The equations for these preferred speed relationships are as follows:

$$V_{rat}=(C/3600)*W_{doc};$$

$$V_{hsn}=V_{rat}*(L_{doc}+G_{hsn})/W_{doc};$$

where:

$V_{rat}$=instantaneous velocity of the right angle turn transports 24, 36 (in/s);

$V_{hsn}$=instantaneous velocity of the high speed nip 34 (in/s);

C=instantaneous cut sheet rate (sheets/hr);

$W_{doc}$=width of the cut sheet (inches);

$L_{doc}$=length of the cut sheet (inches);

$G_{hsn}$=predetermined inter-sheet gap downstream of the high speed nip 34 (required for downstream processing) (inches).

Figure 4A:
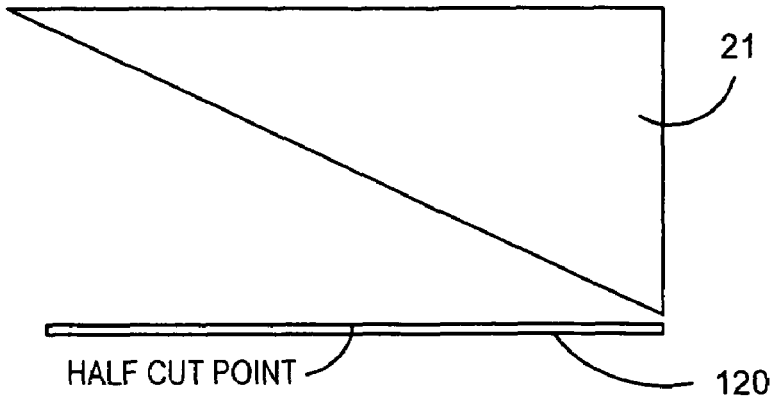
FIGS. 4A-4C depict operation of a guillotine cutter.
Figure 4B:
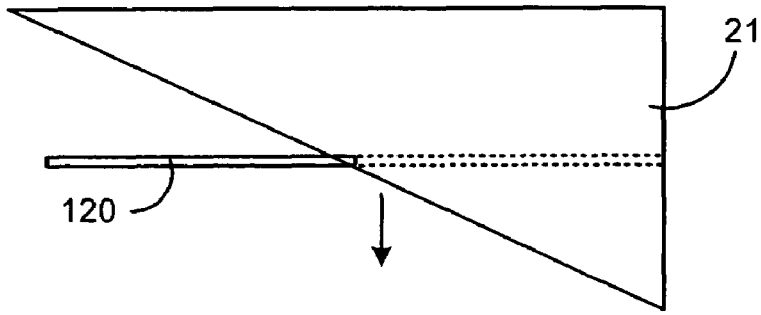
Figure 4C:
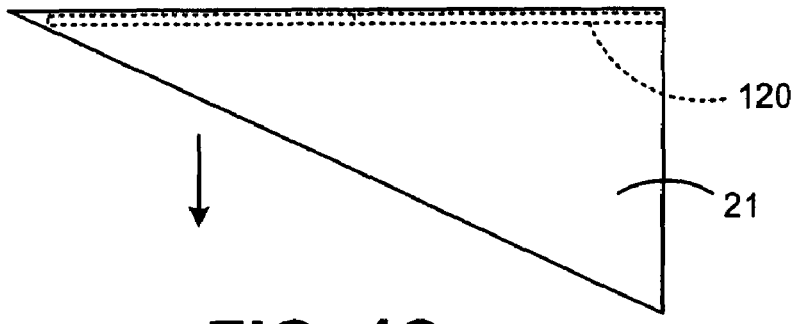

FIGS. 4*a*-4*c* depict the guillotine cutter 21 through a downward cutting motion, starting at a beginning position in 4*a*, to a finished cut position in 4*c*. Guillotine cutter blade 21 preferably has an edge that is vertically inclined at an angle above the path of web 120. As the blade 21 is lowered (FIG. 4*b*) the blade 21 edge comes into contact with the web 120 and cuts across its width (from right to left in FIGS. 4*a*-*c*). In FIG. 4*c*, the blade has reached its bottom position, and the whole width of the web 120 has been cut.

Alternatively, blade 21 can be stopped at the position shown in FIG. 4*b*, and only the right half of the web 120 has been cut. This technique is used when the web 120 is comprised of side-by-side sets of sheets, and where the system can only process one of the sheets. The limitation for processing only a single sheet can result if the second sheet belongs to a new collation, and there is not an available parking spot for the new collation. The other half of the web 120 can be cut when the system is ready to start processing the collection of sheets for the next mailpiece.

Figure 5:
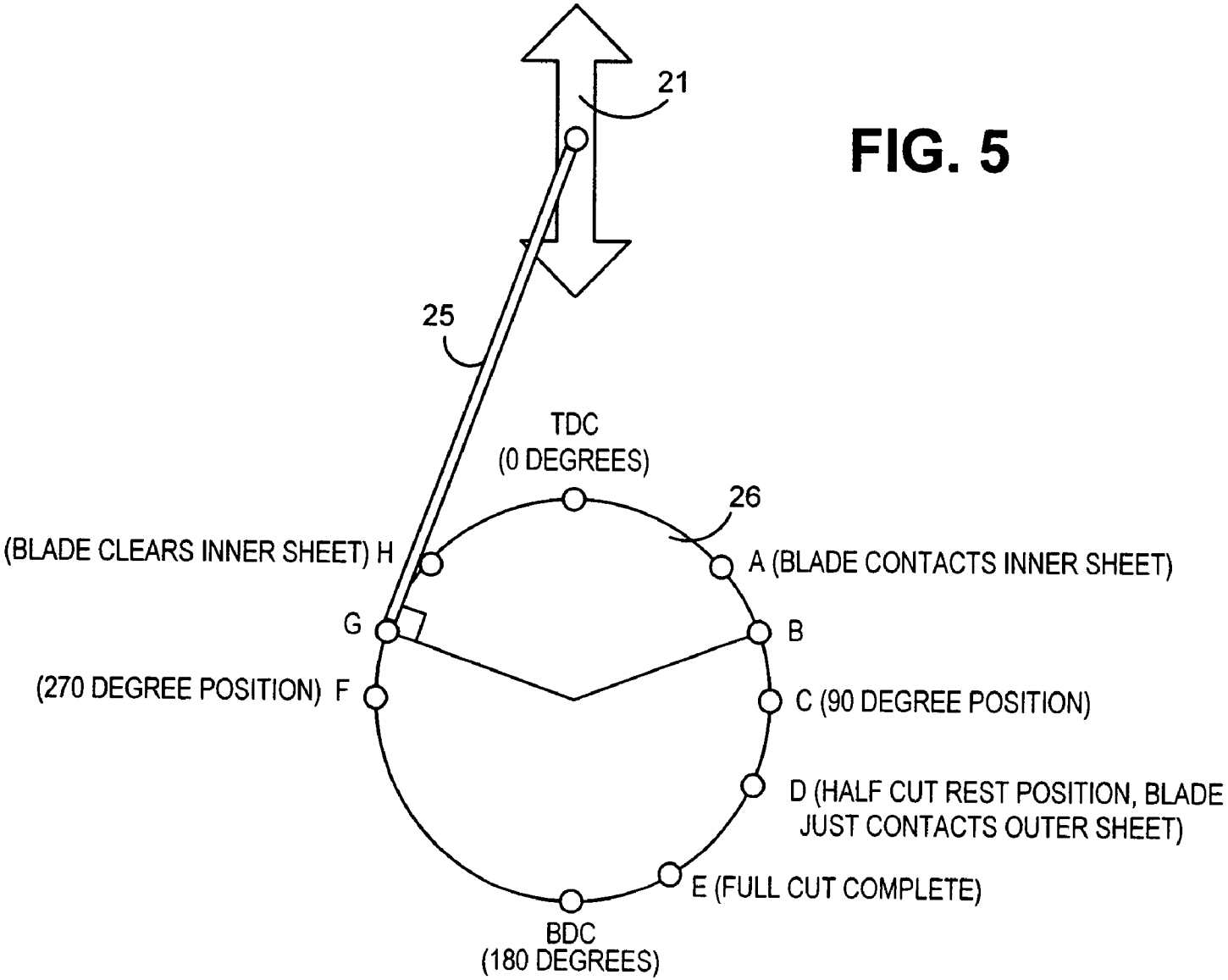
FIG. 5 depicts a rotary cycle for a motor powering a guillotine blade.

FIG. 5 is a diagram depicting a preferred embodiment for driving the motion of the cutter blade 21. Cutter blade 21 is linked to a rotary motor crank 26 by an arm (or linkage) 25. As the motor crank 26 makes a 360 degree rotation in the clockwise direction, the cutter blade 21 undergoes a complete down and up cutting cycle. When the arm 25 is rotated to point TDC, the blade 21 is positioned at top-dead-center above the web 120. When the motor crank 26 has rotated the arm 25 to position BDC, the blade will be at bottom-dead-center of its cutting cycle.

It will be understood by those skilled in the art that motor crank 26 may also be coupled to the arm 25 through a coupling ratio other than unity. Thus a complete 360 degree cutting cycle may actually correspond to more or less than a full rotation of a motor, or even multiple rotations. Accordingly, the term "rotary motor" in this application shall be understood to mean the motor and any corresponding coupling that results in movement of the linkage arm 25.

Positions A-H of the rotary motor crank 26 in FIG. 5 are other key positions in the cutting cycle. Position A represents the point on the rotation where the blade 21 first comes into contact with the web. Position A in FIG. 5 would roughly correspond to the position of the blade 21 depicted in FIG. 4*a*. Position D in FIG. 5 represents a half-cut position that corresponds to the blade 21 position in FIG. 4*b*. Rotary position E represents the position in the rotary cycle of motor crank 26 where the web 120 has been completely cut (FIG. 4*c*). The blade 21 completes its downward movement at BDC in the rotary cycle, and rises back up from BDC to TDC. At position H, while rising, the blade 21 rises above the horizontal position of the web 120. In the preferred embodiment, as will be described further below, the cutter transport 90 resumes transport of the web after point H in the rotary cutting cycle has passed.

Figure 6:
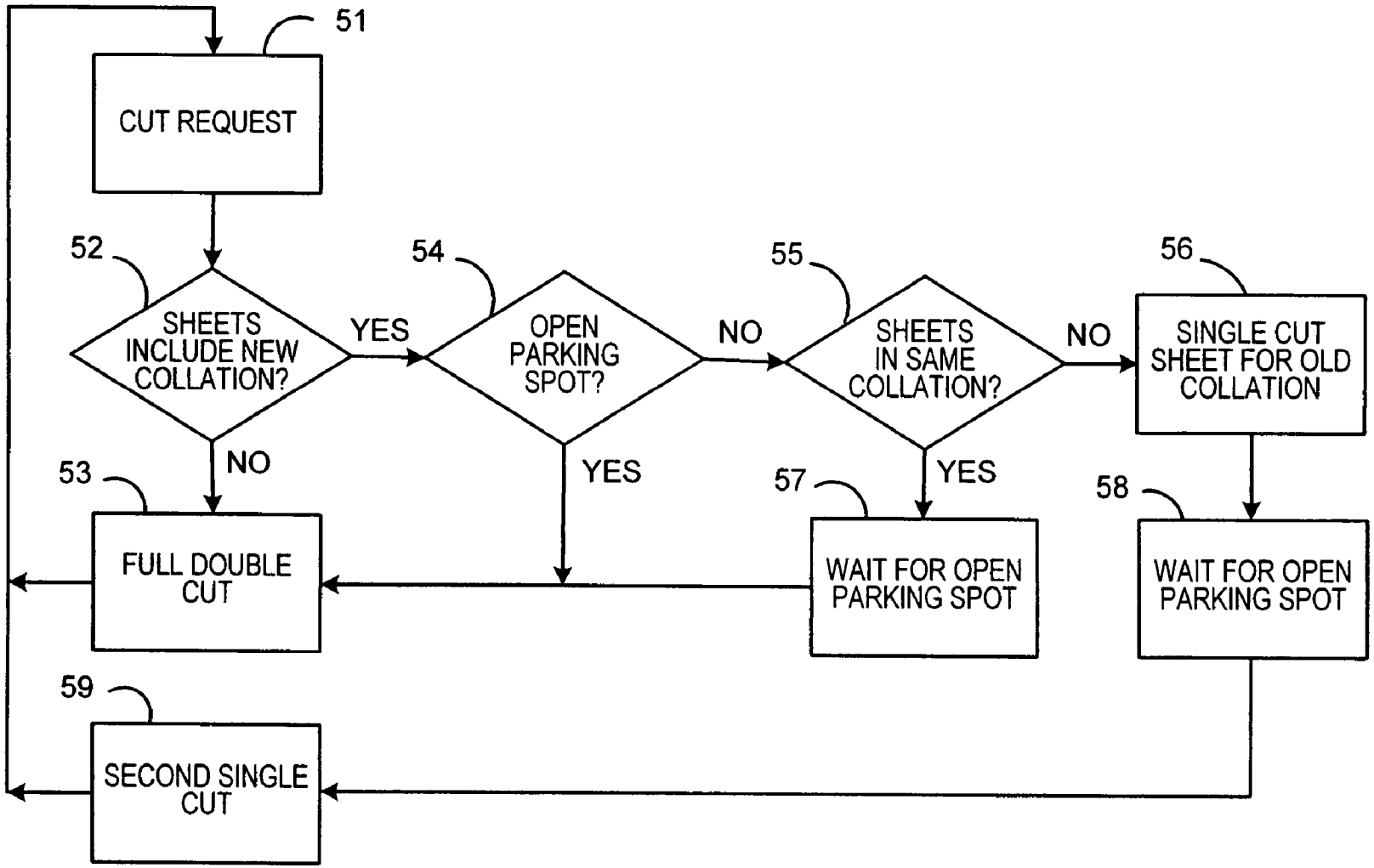
FIG. 6 depicts a logic flow for cutting sheets for improved throughput.

FIG. 6 depicts the logic for cutting side-by-side sheets in order to achieve improved throughput. When the web and the cutter 21 are ready, a cut request is generated at step 51 to begin the cutting process. At step 52, sensors 12 and 13 determine whether the set of sheets ready for cutting include a sheet that is part of a new collation. If there are no sheets for a new collation in the set, then the cutter 21 executes a full double-cut, with both sheets of the 2-up web being cut and transported away (step 53). If there are no sheets for a new collation, then it is safe to assume that the determination has already been made that there is a parking spot available for that collation for which processing has already begun. Thus, a full double cut is always acceptable when there is no sheet belonging to a new collation.

If sensors 12 and 13 detect a sheet belonging to a new collation within the set to be cut, then a further determination must be made whether there is a parking spot to accommodate the new collation (step 54). If there is an open parking spot, then the improved system and method proceed with a full double cut across the web (step 53).

If there is no open parking spot, then further steps are taken, starting at step 55, depending on whether the sheets in the set belong to the same collation. If the sheets belong to the same collation, then the cutter 21 must wait for a parking spot to become available (step 57). However, if one of the sheets is a remaining portion of a collation that has already been started, then the cutter 21 performs a single cut to remove the sheet belonging to the already started collation. The continuous transport 25 advances the single sheet to the nips 24, for the single sheet to be processed in advance of the rest of the set. After a parking spot becomes available (step 58), the remaining sheet, or sheets, of the set can be cut. After a set has been double cut, or had two single cuts, then the system is ready for the next cut request (step 51).

Figure 7A:
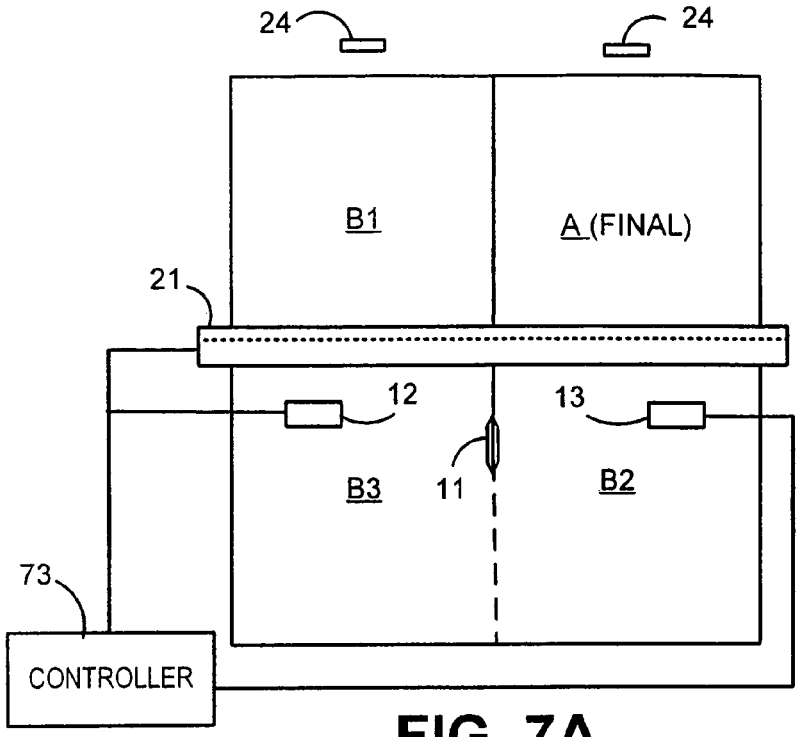
FIGS. 7A and 7B depict an arrangement of sheets being cut.
Figure 7B:
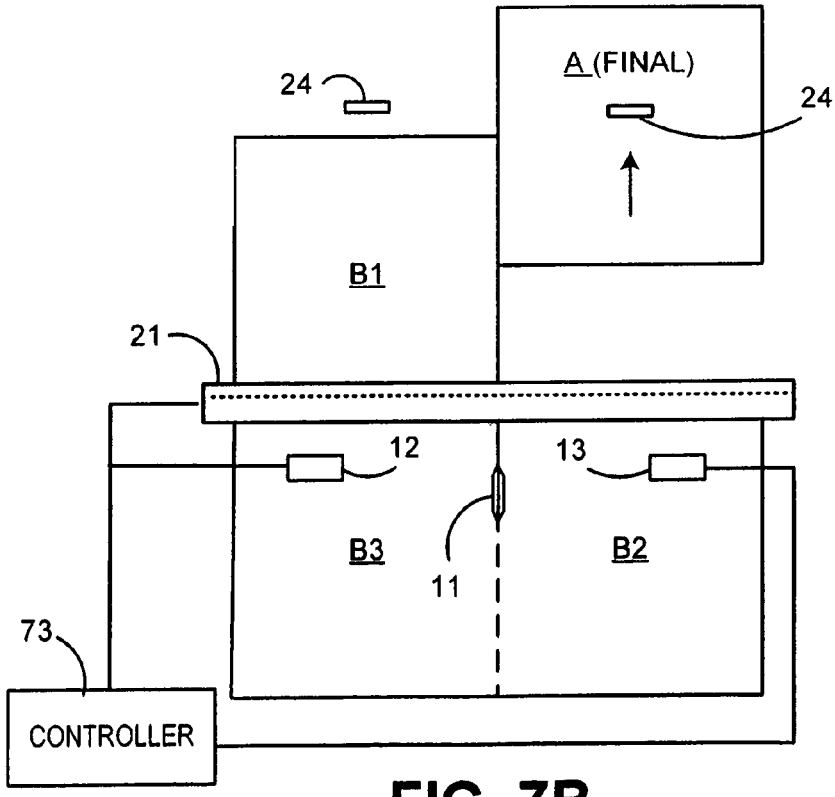

FIG. 7A depicts an exemplary arrangement of 2-up sheets. Sheet A is the final sheet of a collation that is already being processed. Using the algorithm of FIG. 6, if a parking spot was available then sheets A and B1 from the set would be double cut. However, if there were no available parking spots then only sheet A would be cut and transported away from the cutter 21, as depicted in FIG. 7B. For the single cut shown in FIG. 7B, a guillotine cutter would be brought to rest at the position shown in FIG. 4B. A controller 73 is coupled to the sensors 12 and 13 and to the cutter 21 to provide the logic and control described herein. Controller 73 can be any kind of microprocessor or computer, as would be well known in the art, that is specially programmed with the functionality and algorithms describe herein.

Although the invention has been described with respect to preferred embodiments thereof, it will be understood by those skilled in the art that the foregoing and various other changes, omissions and deviations in the form and detail thereof may be made without departing from the spirit and scope of this invention.

What is claimed is:

1. A method for transversely cutting a web of printed material into separate sheets in a sheet processing system for processing collations of sheets, wherein the web includes at least two side-by-side sheets printed transversely across a width of the web, wherein the side-by-side sheets have been separated from each other in a direction parallel to a length of the web; the method comprising:

receiving a set of side-by-side sheets to be transversely cut from the web, wherein one or more of the sheets in the set belongs to a new collation for which sheets have not previously been cut;

determining whether sufficient collation parking spots exist to accommodate a new collation;

if there are no available collation parking spots, and if all of the set of side-by-side sheets belong to the new collation, then delaying transverse cutting until an open collation parking spot becomes available;

if there are no available collation parking spots, and if a subset of the set of side-by-side sheets belongs to a prior collation for which some sheets have already been cut, then partially transversely cutting the web to separate only the sheet, or sheets, that belong to the prior collation, and delaying a remainder of the transverse cutting until the open collation parking spot becomes available; and if there is an available collation parking spot, then transversely cutting the entire set of side-by-side sheets.

2. The method of claim 1 wherein the steps of transverse cutting are done with a guillotine style cutting blade and cutting is comprised of rapidly lowering the guillotine blade onto the web to be cut.

3. The method of claim 2 wherein the step of partially transverse cutting further comprises partially lowering the guillotine style cutting blade.

4. The method of claim 3 wherein the step of cutting the remainder of the transverse cutting is accomplished by resuming downward cutting by the guillotine blade to resume cutting, and then retracting the blade above a plane of the web.

5. The method of claim 1 further including a step of determining what collation a sheet belongs to by scanning a marking on the sheet.

6. The method of claim 1 further including a step of shingling cut sheets subsequent to transverse cutting.

7. The method of claim 6 wherein the step of shingling is combined with turning the side-by-side sheets at a right angle to form a single stream of shingled sheets.

8. The method If claim 6 further comprising separating a lead sheet of the shingled sheets via a high speed transport that pulls the lead sheet out of the stream of shingled sheets.

9. A cutting apparatus for transversely cutting a web of printed material into separate sheets in a sheet processing system for processing collations of sheets, wherein the web includes at least two side-by-side sheets printed transversely across a width of the web, a web splitter arranged to separate the side-by-side sheets a direction parallel to a length of the web;

a transverse cutter arranged to cut across the web;

a cutter controller coupled to the transverse cutter and controlling the operation of the transverse cutter as follows:

determining that one or more of the sheets in a set belongs to a new collation for which sheets have not previously been cut;

determining whether sufficient collation parking spots exist to accommodate a new collation;

if there are no available collation parking spots, and if all of the set of side-by-side sheets belong to the new collation, then delaying transverse cutting until an open collation parking spot becomes available;

if there are no available collation parking spots, and if a subset of the set of side-by-side sheets belongs to a prior collation for which some sheets have already been cut, then partially transversely cutting the web to separate only the sheet, or sheets, that belong to the prior collation, and delaying a remainder of the transverse cutting until the open collation parking spot becomes available; and if there is an available collation parking spot, then transversely cutting the entire set of side-by-side sheets.

10. The apparatus of claim 9 wherein the transverse cutter is comprised of a guillotine style cutting blade arranged for rapid lowering onto the web to be cut.

11. The apparatus of claim 10 wherein the cutter controller is further programmed to control the transverse cutter to partially transverse cut by partially lowering the guillotine style cutting blade.

12. The apparatus of claim 11 wherein the cutter controller is further programmed to control the transverse cutter to cut the remainder of the transverse cut by resuming downward cutting by the guillotine blade, and then retracting the blade above a plane of the web.

13. The apparatus of claim 12 further comprising one or more scanners, coupled to the cutter controller, for scanning the sheets to determine what collation a sheet belongs to.

14. The apparatus of claim 9 further including a shingling arrangement positioned to shingle sheets downstream of the transverse cutter.

15. The apparatus of claim 14 wherein the shingling device is comprised of a right angle turn arranged to transport and turn the side-by-side sheets at a right angle to form a single stream of shingled sheets.

16. The apparatus of claim 14 further comprising a high speed separator transport downstream of the shingling device and arranged to separate a lead sheet of the shingled sheets by pulling the lead sheet out of the stream of shingled sheets.

* * * * *